US006234750B1

(12) United States Patent
Mielke et al.

(10) Patent No.: US 6,234,750 B1
(45) Date of Patent: May 22, 2001

(54) INTERLOCKED COMPRESSOR STATOR

(75) Inventors: Mark J. Mielke, Blanchester; David E. Bulman, Cincinnati; Kenneth E. Seitzer, Mason, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/267,259

(22) Filed: Mar. 12, 1999

(51) Int. Cl.[7] ..... F01D 1/02

(52) U.S. Cl. ..... 415/189; 416/191; 416/209.2; 416/209.3

(58) Field of Search ..... 415/189, 191, 415/193, 208.1, 209.2, 209.3, 209.4, 210.1

(56) References Cited

U.S. PATENT DOCUMENTS

| | | | | |
|---|---|---|---|---|
| 2,799,473 | * | 7/1957 | Smith et al. | 415/137 |
| 3,085,398 | * | 4/1963 | Ingleson | 415/189 X |
| 3,142,475 | * | 7/1964 | Bobo et al. | 415/139 |
| 3,302,926 | * | 2/1967 | Bobo | 415/189 X |
| 3,423,071 | * | 1/1969 | Noren | 415/189 |
| 3,443,791 | * | 5/1969 | Sevetz et al. | 415/209.3 X |
| 3,728,041 | * | 4/1973 | Bertelson | 415/189 |
| 3,824,034 | * | 7/1974 | Leicht | 415/209.2 |
| 3,918,832 | | 11/1975 | Shuttleworth et al. | 415/217 |
| 3,970,318 | * | 7/1976 | Tuley | 473/514 |
| 3,985,465 | * | 10/1976 | Sheldon et al. | 415/189 |
| 4,126,405 | | 11/1978 | Bobo et al. | 415/115 |
| 4,621,976 | * | 11/1986 | Marshall et al. | 415/191 |
| 4,632,634 | | 12/1986 | Vinciguerra et al. | 415/139 |
| 4,639,189 | * | 1/1987 | Rosman | 415/115 |
| 5,149,250 | * | 9/1992 | Plemmons et al. | 415/209.3 |
| 5,154,577 | * | 10/1992 | Kellock et al. | 415/170.1 |
| 5,176,496 | | 1/1993 | Correia et al. | 415/209.2 |
| 5,197,856 | * | 3/1993 | Koertge et al. | 415/209.3 |
| 5,248,240 | * | 9/1993 | Correia | 415/209.1 |
| 5,846,050 | * | 12/1998 | Schilling | 415/209.2 X |

* cited by examiner

*Primary Examiner*—John E. Ryznic
(74) *Attorney, Agent, or Firm*—Andrew C. Hess; Nathan D. Herkamp

(57) ABSTRACT

A compressor stator includes a casing having a circumferentially extending slot therein in which are mounted a plurality of vane sectors. Each sector includes a plurality of vanes extending between outer and inner bands, with each outer band being mounted in the slot. A plurality of tabs are ranged in interlocked pairs between the outer bands and casing for unloading adjacent sectors from each other.

20 Claims, 5 Drawing Sheets

INTERLOCKED COMPRESSOR STATOR

The U.S. Government may have certain rights in this invention pursuant to contract number N0001 9-96-C-0176 awarded by the U.S. Department of the Navy.

BACKGROUND OF THE INVENTION

The present invention relates generally to gas turbine engines, and, more specifically, to compressor stators therein.

In a gas turbine engine, air is pressurized in a compressor and mixed with fuel in a combustor and ignited for generating hot combustion gases which flow through one or more turbine stages which extract energy therefrom. A high pressure turbine is joined to a compressor rotor for powering the compressor, and a low pressure turbine is typically provided for powering a fan disposed upstream of the compressor in a typical turbofan gas turbine engine configuration.

In a typical multistage axial compressor, many rows of rotor blades extend radially outward from the compressor rotor for pressurizing in turn the air channeled therethrough for increasing the pressure thereof. The compressor rotor is mounted inside a compressor stator from which extends radially inwardly a plurality of rows of stator vanes.

The stator vanes are either variable or fixed in angular pitch relative to the axial, downstream direction of the air being pressurized. A variable vane has a spindle which extends through the compressor casing and is suitably actuated for adjusting the angular rotation or pitch thereof. The fixed stator vanes are mounted to the casing individually or in multiple vane sectors for each row.

A typical vane sector includes several stator vanes extending radially inwardly from an outer band, and fixedly joined thereto. The outer band is arcuate and includes forward and aft rails which are mounted in a circumferentially extending slot in the compressor casing having corresponding forward and aft mounting hooks therefor. The vanes are thusly suspended radially inwardly from the surrounding compressor casing, with the inner ends thereof being disposed radially above the compressor rotor between blade rows.

The sectors may also include inner bands fixedly joined to the vane inner ends. An arcuate seal may be mounted to the inner bands for sealing the stationary vane sectors from the rotating compressor rotor during operation.

As the air is pressurized during operation, aerodynamic reaction force is carried through the vanes and into their outer bands. The outer bands must therefore be circumferentially retained in the casing to withstand the aerodynamic reaction forces.

A typical compressor casing is split in two semicircular half casings which are fixedly joined together in a complete ring at corresponding horizontal flanges at diametrically opposite ends of the half casings. The vane sectors are installed individually into each half casing by being circumferentially inserted into the corresponding retention slots thereof until each half casing receives its complement of sectors, typically ranging from about four to six.

The aerodynamic reaction forces are restrained by providing a stop or key at one of the horizontal flanges in each half casing against which the outer band of an adjacent vane sector may circumferentially abut for preventing further circumferential movement. The additional vane sectors in each half casing circumferentially abut each other at their outer bands. In this configuration, the reaction forces in each of the vane sectors is carried through their corresponding outer bands into the next adjoining outer band until the reaction forces are collectively carried through the single key in each half casing.

Accordingly, the first vane sector in each half casing directly abuts the sector stop and must not only carry the aerodynamic reaction forces generated in its vanes, but also the aerodynamic reaction forces generated in each of the circumferentially adjoining vane sectors of the half casing. The last vane sector in each half casing therefore carries only its portion of the reaction forces to its neighbor.

Since the compressor is a rotary component it is subject to vibration in addition to the aerodynamic reaction forces. The sectors are therefore subject to vibration and wear from the vibratory and aerodynamic reaction forces. Since each vane sector is circumferentially loaded in turn by its neighbor in each half casing, the sector closest to the stop is most highly loaded, with the circumferential reaction loads in its neighbors decreasing in turn to the last sector in the half casing which experiences the least circumferential reaction load.

But for the loading experienced by the vane sectors, they are substantially identical in configuration and operation. However, the increased circumferential loading from sector to sector causes correspondingly different rates of wear between the outer bands and the stator casing and different levels of vibratory response in the vanes. The high loaded vane sectors are therefore subject to more wear and vibration than the low loaded vane sectors which correspondingly decreases the useful life of the sectors and the casing in which they are mounted.

Accordingly, it is desired to provide an improved compressor stator for accommodating the aerodynamic reaction forces carried between the vane sectors and the casing.

BRIEF SUMMARY OF THE INVENTION

A compressor stator includes a casing having a circumferentially extending slot therein in which are mounted a plurality of vane sectors. Each sector includes a plurality of vanes extending from an outer band, with each outer band being mounted in the slot. A plurality of tabs are ranged in interlocked pairs between the outer bands and casing for unloading adjacent sectors from each other.

DETAILED DESCRIPTION OF THE INVENTION

Figure 1:
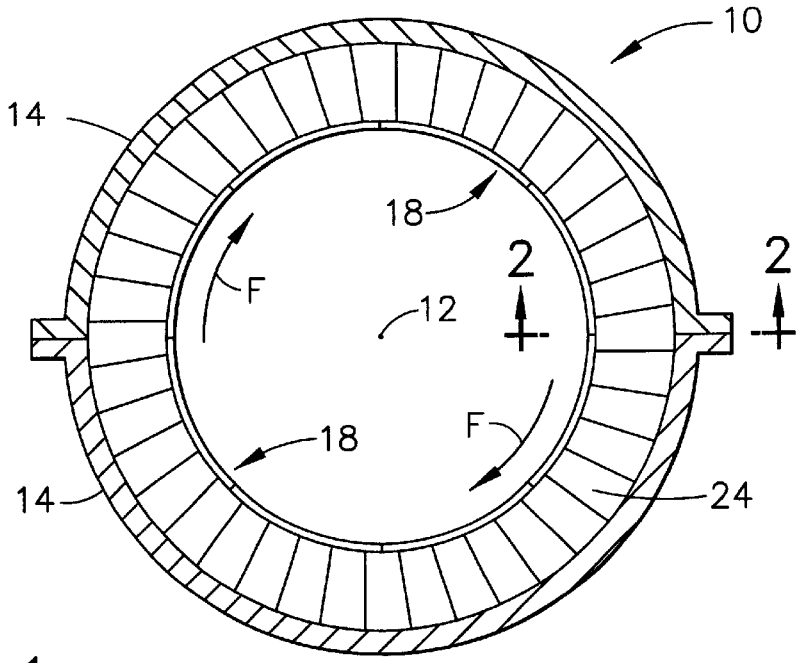
FIG. 1 is a radial sectional view of a gas turbine engine compressor stator in accordance with an exemplary embodiment of the present invention.
Figure 2:
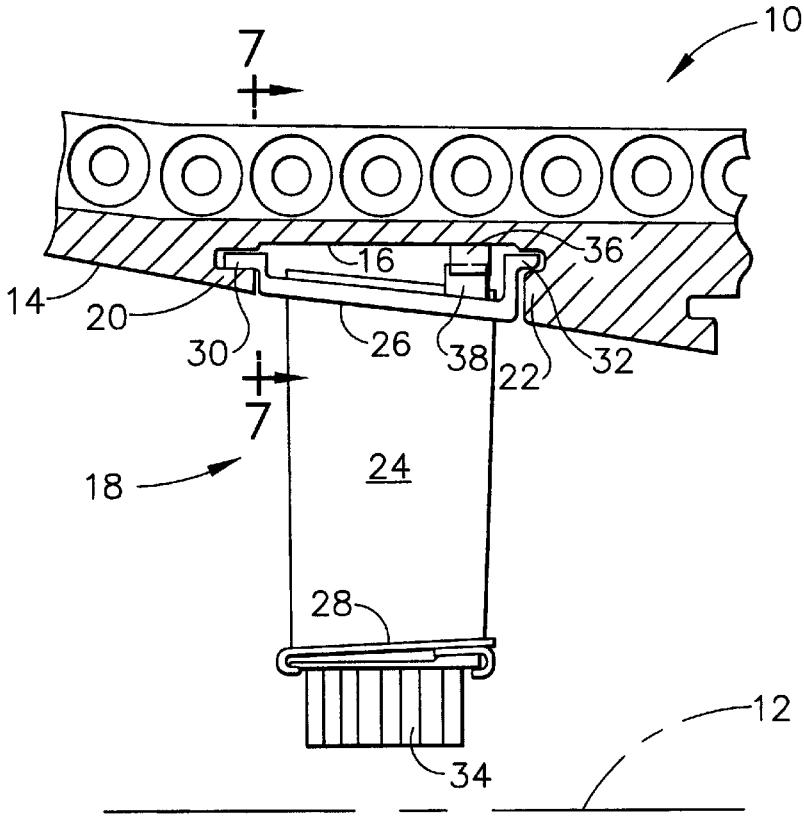
FIG. 2 is a an axial sectional view through the horizontal splitline of the stator illustrated in FIG. 1 and taken along line 2—2.

Illustrated in FIGS. 1 and 2 is an annular compressor stator of a multistage axial compressor of a gas turbine engine 10 which is axisymmetrical about a longitudinal or axial centerline axis 12. The stator is shown in relevant part including two semicircular, arcuate half casings 14 which are fixedly joined together at a horizontal splitline to collectively form an annular casing.

The casing 14 is conventionally formed in two halves having horizontal flanges through which fastening bolts are provided for fixedly joining together the two halves upon assembly. As shown in FIG. 2, the casing 14 includes a circumferentially extending retention slot 16 in which a plurality of circumferentially adjoining vane sectors 18 are mounted. Both casing and sectors may have any conventional form. Typically there are about four to six sectors per half casing 14, with four sectors being shown in each half for a total of eight sectors in the full casing.

Figure 3:
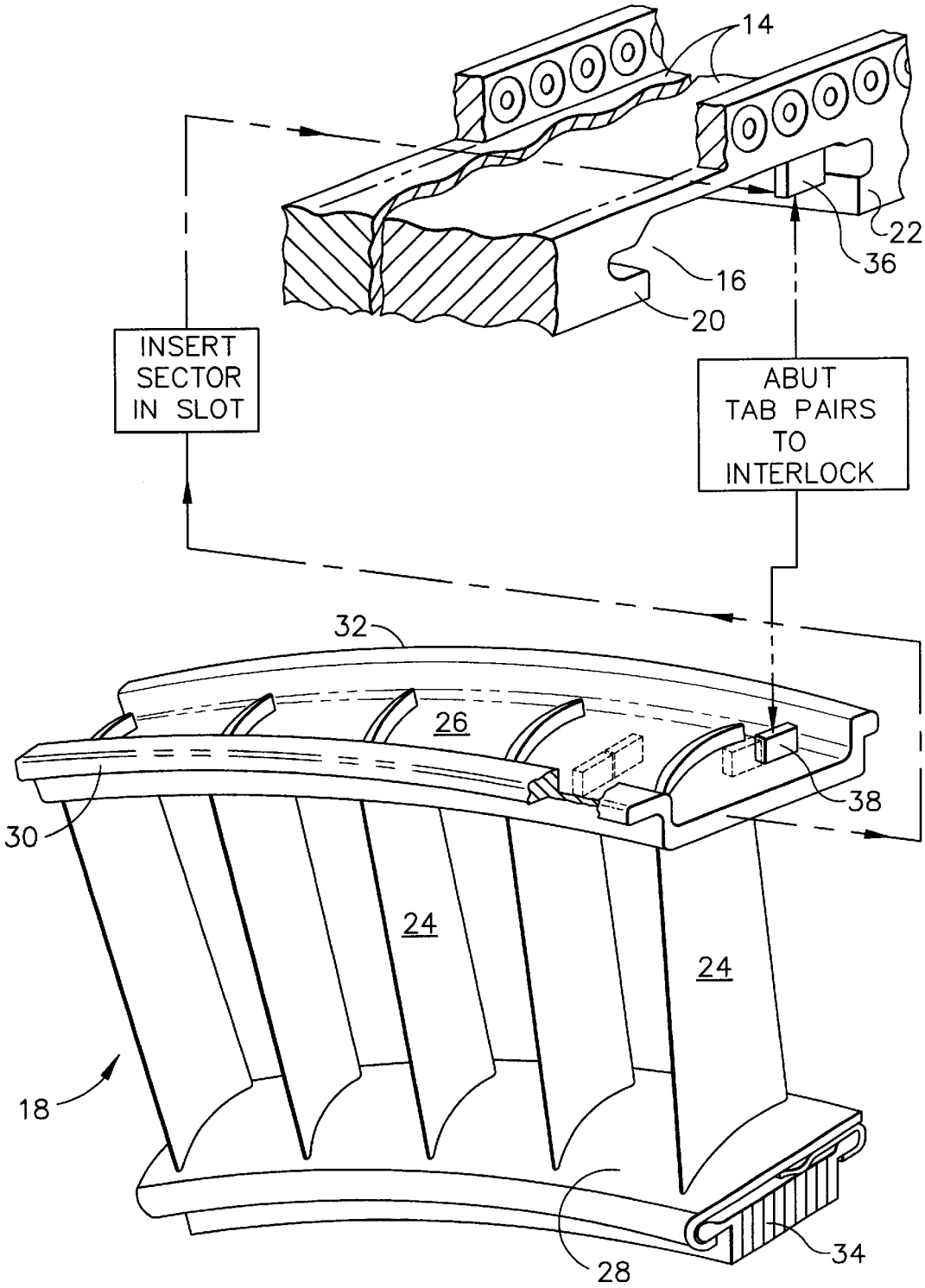
FIG. 3 is a schematic representation of an exemplary vane sector of FIG. 2 being installed into a corresponding slot of the casing for PATENT interlocking a pair of retaining tabs in a first position.

As best shown in FIG. 3, each half casing 14 includes axially forward and aft hooks 20,22 axially bounding the casing slot 16, with the casing slot 16 being open radially inwardly as well as open at its circumferentially opposite ends at the horizontal flanges.

Each of the vane sectors 18 typically includes a plurality of vanes 24, although a single vine may be therein, extending radially inwardly from an arcuate outer band 26. Each sector typically also includes an arcuate inner band, and between which outer and inner bands the vanes extend.

Each of the outer bands 26 is mounted in the casing slot 16 for axial and radial retention therein by a pair of forward and aft arcuate rails 30,32 extending circumferentially on opposite axial sides thereof. The rails 30,32 define hooks in axial section which are complementary to the casing hooks 20,22 and are disposed thereon for permitting circumferential sliding assembly therealong, while being retained both radially and axially.

The several vane sectors 18 are suspended radially inwardly from the half casings 14 by their outer bands 26 engaging the retention slots 16 in a conventional manner. An arcuate seal 34, as shown in FIGS. 2 and 3, is suitably mounted to the respective inner bands 28 for forming an effective seal with the compressor rotor (not shown) disposed radially therebelow in an exemplary embodiment.

Extending radially and outwardly from the compressor rotor are corresponding rows of rotor blades (not shown) which would be disposed on opposite sides of the stator stage illustrated in FIG. 2, but are removed for clarity of presentation. During operation, the rotor blades pressurize ambient air as it flows axially through the compressor, with the pressurized air flowing between adjacent vanes 24 for further compression in the next succeeding blade row. Aerodynamic reaction forces F are experienced by the individual vanes 24, as illustrated in FIG. 1, which is directed in the exemplary clockwise direction illustrated. These reaction forces F must be suitably accommodated by the stationary half casings 14 to prevent circumferential movement of the vane sectors relative thereto.

In accordance with the present invention, means in the exemplary form of respective pluralities of first and second retention stops or tabs 36,38 are provided for circumferentially interlocking each of the sectors 18 to the half casings 14.

Each of the first, or radially outer, tabs 36 is fixedly joined to tho casing 14 within the retention slot 16 in any suitable manner such as being milled integrally therewith, or attached by brazing or welding as desired. Each outer tab 36 extends radially inwardly from the casing, and the several outer tabs 36 are circumferentially spaced apart from each other in circumferential alignment with respective ones of the second tabs 38.

Each of the second, or radially inner, tabs 38 is fixedly joined to respective ones of the outer bands 26 in any suitable manner such as being integrally cast or milled therewith or being affixed thereto by brazing or welding. Each of the inner tabs 38 extends radially outwardly from the corresponding outer band 26 and is interdigitated or interlocked with the respective outer tabs 36 for providing circumferential retention of the individual vane sectors.

As initially shown in FIG. 2, each of the inner tabs 38 circumferentially abuts a respective one of the outer tabs 36 in an interlocked tab pair after assembly for carrying respective portions of the aerodynamic reaction forces from the vane sectors to the surrounding casing 14. The interlocking tab pairs 36,38 thusly provide effective means for circumferentially locking each of the outer bands 26 to the respective half casings 14, which in turn circumferentially unloads adjoining sectors.

As initially shown in FIG. 3, each of the half casings 14 is open at its circumferentially opposite ends for circumferentially receiving each of the vane sectors 18 in turn during the assembly process. In a preferred embodiment, each of the vane sectors 18 includes a corresponding inner tab 38 so that each sector is interlocked with a corresponding outer tab 36 extending from the casing, and the interlocked sectors circumferentially directly adjoin each other. In this way, each of the outer bands 26 is locked to the casing 14 by the respective tab pairs 36,38.

A small circumferential end clearance may be provided between the circumferentially adjoining outer bands 26 for permitting thermal expansion during operation without circumferential contact between the adjoining outer bands. In this way, circumferential retention of the individual sectors is provided solely by the corresponding tab pairs 36,38, and the respective aerodynamic reaction force from each sector is thusly carried by its own outer band into the casing for unloading adjoining sectors which need no longer carry the additional reaction loading which would otherwise occur without the multiple tab pairs.

Since the outer tabs 36 are disposed axially between tho forward and aft hooks 20,22 in the casing slot 16 as illustrated in FIG. 3, the inner tabs PATENT 38 are correspondingly disposed axially between the forward and aft rails 30,32 of the outer bands 26. However, if the tab pairs 36,38 are disposed in the same axial plane from sector to sector, it would be impossible to assemble the individual sectors in the half casings since the aligned outer tabs in each half casing would prevent the circumferential insertion of the several vane sectors therepast.

Accordingly, in a preferred embodiment of the invention, the tab pairs 36,38 are axially offset from each other for permitting each of the sectors 18 to be inserted in turn through the same or common retention slot 16 without obstruction by the outer tabs 36 extending radially inwardly therein. FIG. 3 illustrates in solid line the location of a first one of the inner tabs 38 at one circumferential end of the outer band 26 directly adjacent the aft rail 32 of the first sector 18. Illustrated also in phantom line are the footprints of the location of three other inner tabs 38 axially offset from each other.

Figure 4:
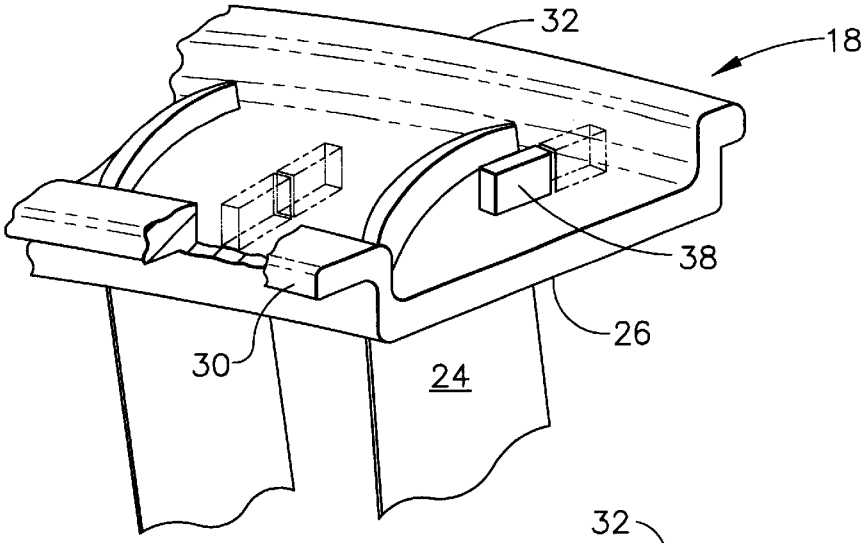
FIG. 4 is an isometric view of a portion of the vane sector illustrated in FIG. 3 with the tabs therein being disposed in a second position different than the first position illustrated in FIG. 3.

FIG. 4 illustrates in solid line the location of a second one of the inner tabs 38 for the second sector 18 directly adjoining the first sector 18 illustrated in FIG. 3. Also shown in phantom line are the footprints of the axially offset inner tabs 38 for other sectors.

Figure 5:
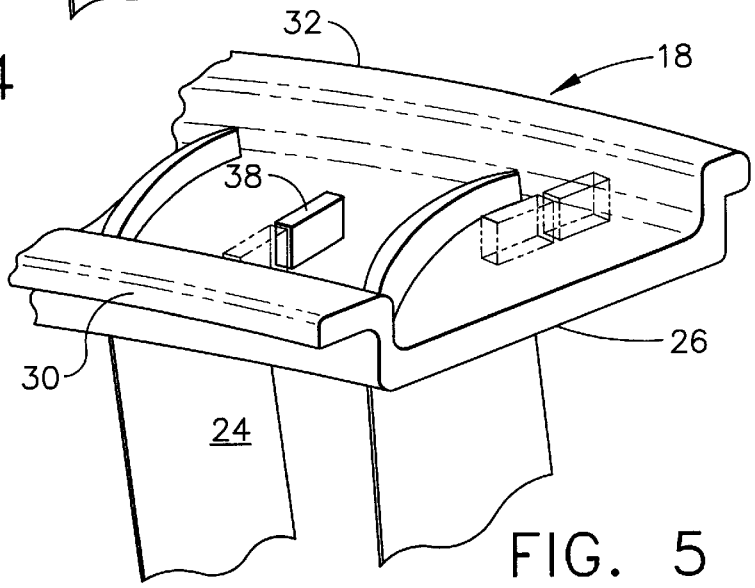
FIG. 5 is an isometric view of a portion of the vane sector illustrated in FIG. 3 with the tabs therein being disposed in a third position different than the second position illustrated in FIG. 4.

FIG. 5 illustrates in solid line the location of a third one of the inner tabs 38 for a third vane sector 18 having an axial offset from the first and second locations illustrated in FIGS. 3 and 4. Shown in phantom line are the footprints of the axially offset inner tabs of other sectors of the half casing.

Figure 6:
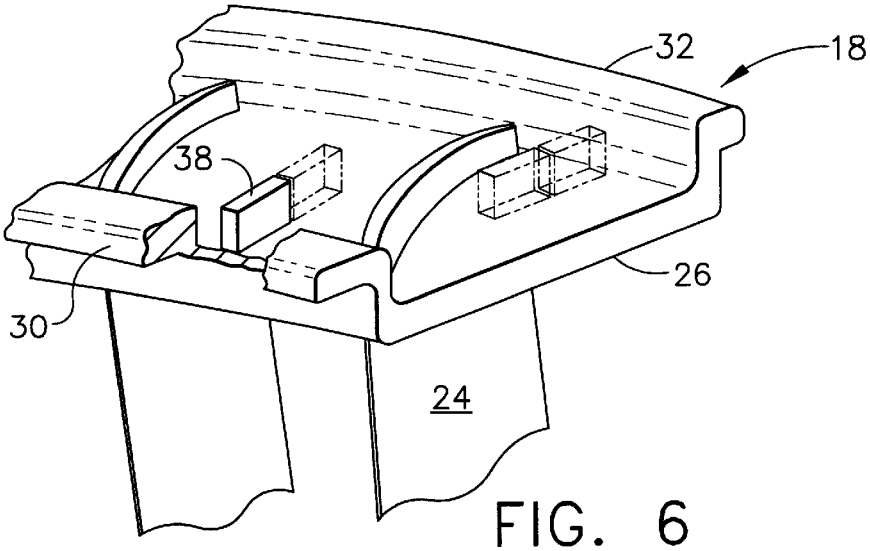
FIG. 6 is an isometric view of a portion of the vane sector illustrated in FIG. 3 with the tabs therein being disposed in a fourth position different than the third position illustrated in FIG. 5.

FIG. 6 illustrates in solid line the location of a fourth one of the inner tabs 38 at yet another axially offset position directly adjacent the forward rail 30 of a fourth one of the vane sectors 18. Shown again in phantom line are the axially offset footprints of inner tabs of the first three vane sectors in the half casing.

In FIGS. 3 and 4, sufficient space is available for mounting the respective inner tabs 38 at one of the circumferentially opposite ends of the outer band 26, axially offset from each other, and without interference with the projection of the adjacent vane 24 through the outer band. However, the projection of that vane 24 interferes with the placement of the inner tabs 38 of the third and fourth sectors at this end of the outer band.

Accordingly, the third and fourth locations for the inner tabs 38 of the third and fourth sectors as shown in FIGS. 5 and 6 are located circumferentially inwardly from the end of the outer band in the available space between the two end vanes 24 illustrated. In this way, the inner tabs 38 for all the vane sectors in a half casing 14 may be axially offset from each other, with the vane sectors 18 being otherwise identical in configuration.

Figure 7:
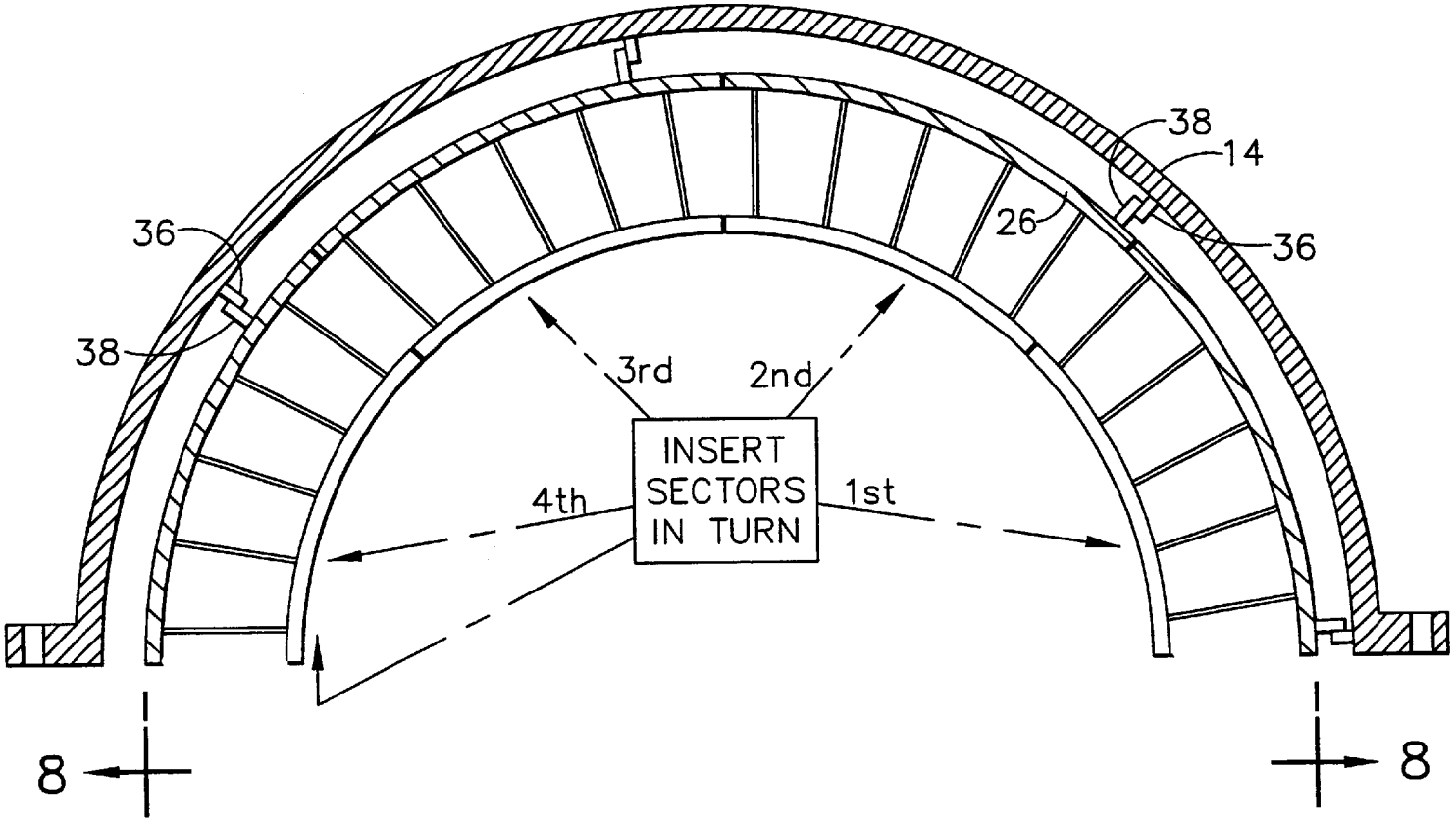
FIG. 7 is a schematic radial sectional view through a portion of the half casing illustrated in FIG. 2 and taken along line 7—7 for showing assembly of the four vane sectors illustrated in FIGS. 3–6 into the corresponding half casing.
Figure 8:
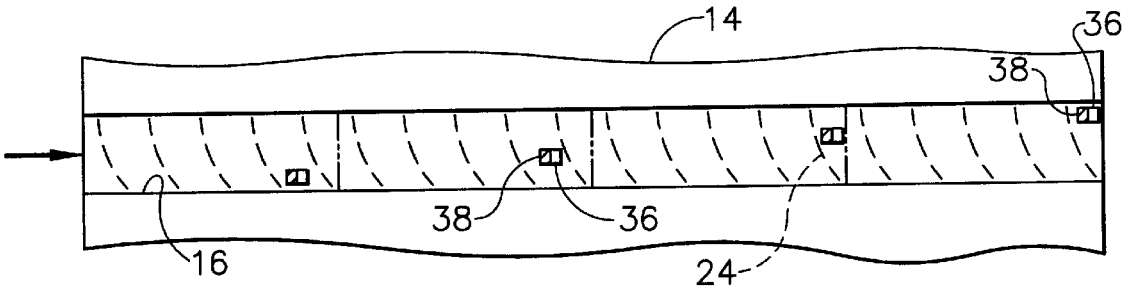
FIG. 8 is a planiform view of the casing slot illustrated in FIG. 7 and taken generally along line 8—8 for showing interlocking tabs between the several vane sectors and the casing.

FIG. 7 illustrates schematically the assembly of the four vane sectors in each of the half casings 14 with the corresponding interlocking of the four tab pairs 36,38. The outer tab pair may be located at one end of the horizontal splitline after being assembled thereat by insertion in the slot from the diametrically opposite horizontal flange. FIG. 8 illustrates in planiform view the retention slot 16 of the half casing 14 through which the respective vane sectors are inserted during assembly. Note that the inner tab 38 of the first vane sector is able to pass, without obstruction, the first three outer tabs 36 it encounters prior to circumferentially abutting the last outer tab 36.

In this method of mounting the several vane sectors 18 to the arcuate half casing 14, each of the sectors 18 is inserted circumferentially into the half casing and circumferentially moved to its final position for interlocking circumferentially each of the sectors to the casing.

As shown in FIGS. 7 and 8, each of the sectors is preferably inserted in turn in the common or same slot 16, with the respective tab pairs 36,38 interlocking each of the sectors in turn to the half casing 14. However, the tab pairs 36,38 must be axially offset from each other to permit assembly and interlocking of the sectors to the half casing in this exemplary embodiment.

As shown in FIGS. 4,7 and 8, the second vane sector 18 has an axially offset inner tab 38 which during assembly through one end of the retention slot 16 will pass without obstruction the first two outer tabs 36 it encounters until circumferentially abutting its corresponding outer tab 36 at the second position illustrated in FIG. 8.

As shown in FIGS. 5,7,and 8, the offset inner tab 38 of the third vane sector 18 permits the circumferential assembly of that sector through the retention slot 16 to pass without obstruction the first outer tab 36 it encounters until it circumferentially abuts the third position of the outer tabs 36 provided for its circumferential abutment.

And, FIGS. 6,7,and 8, illustrate the location of the fourth inner tab 38 of the fourth sector which upon assembly in the common retention slot 16 circumferentially abuts the first outer tab 36 it encounters at the fourth position thereof at the opposite end of the slot 16.

Accordingly, each of the several vane sectors 18 in each half casing 14 may include a respective inner tab 38 suitably axially offset from the neighboring sectors for permitting circumferential insertion of the sectors from one end of the retention slot 16, as illustrated in FIG. 3, until the inner tab 38 circumferentially abuts the outer tab 36 extending from the casing for interlocking therewith. Thusly, each of the several vane sectors may separately be interlocked through corresponding tab pairs 36,38 while permitting individual assembly thereof without obstruction with the several outer tabs 36 provided in each retention slot 16.

In this way, each vane sector may carry its portion of the aerodynamic reaction forces through the corresponding tab pairs 36,38 without one vane sector circumferentially loading an adjoining vane sector. The casing hooks 20,22 and outer band rails 30,32 correspondingly experience reduced loading which reduces the wear therebetween. And, the vanes 24 may experience reduced stress and vibration which increases the useful life thereof.

Although the tab pairs 36 may be provided for each of the vane sectors in each half casing 14, they may be otherwise provided for every other vane sector if desired. In one embodiment (not shown), two of the tab pairs 36,38 may be provided in each half casing 14 with two or more vane sectors being circumferentially retained by each tab pair. Although in this embodiment, load transfer from one vane sector to the next will occur, such load transfer will not accumulate against a single vane sector at the horizontal splitline. Instead, the reaction forces will be spread at two or more locations in each half casing.

The maximum number of axially offset tab pairs 36,38 in each retention slot 16 will be determined for each design application by the size of the individual tabs required for withstanding the loads carried therethrough, the available axial space in the retention slot 16 and outer band 26, and the number of vane sectors in each half casing. Should there be insufficient axial space for axially offsetting a suitable number of the tab pairs in a one to one correspondence with the tab sectors in each half casing, a different embodiment may be used.

Figure 9:
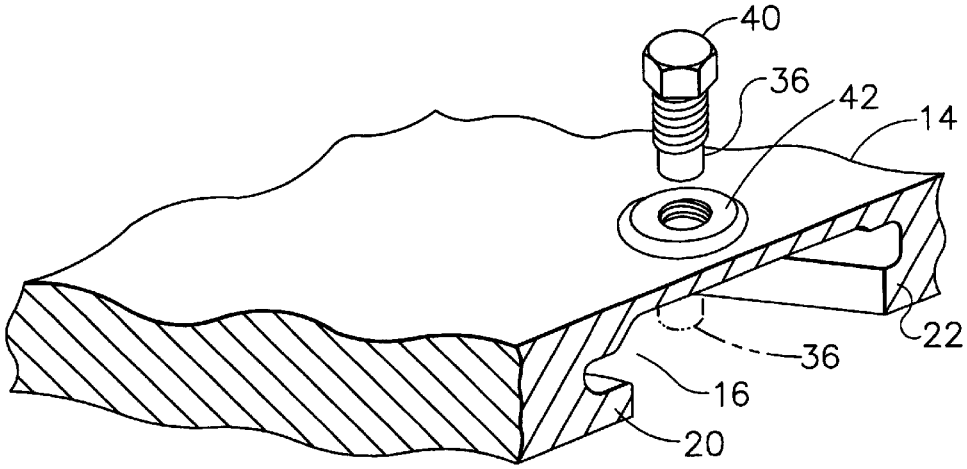
FIG. 9 is an isometric view of a portion of the half casing illustrated in FIG. 3 having a retention tab in accordance with another embodiment of the present invention.

More specifically, FIG. 9 illustrates a portion of the half casing 14 in which the outer tab 36 forms the distal end portion of a threaded bolt 40 which may be threadingly inserted through a corresponding threaded hole 42 through the casing 14. In this embodiment, the bolts 40 may be inserted through their respective holes 42 in turn following assembly of each vane sector 18. Since this embodiment of the outer tabs 36 does not provide interference with the inner tabs 38 on the vane sectors, the vane sectors and their corresponding inner tabs 38 may be identical in configuration, with the inner tabs 38 being located at the same position on the several outer bands 26. The outer tabs 36 at the distal ends of the bolts will then similarly circumferentially abut the corresponding inner tabs 38 provided on the corresponding outer bands.

In the several embodiments disclosed above, aerodynamic reaction forces from the various vane sectors may be independently carried into respective portions of the half casings 14 through the tab pairs 36,38 without unduly transferring circumferential loads from one sector to an adjacent sector. The reduced loading per sector reduces wear between the corresponding rails 30,32 and hooks 20,22, reduces stress and vibration of the vanes themselves, and improves the useful life of the stator.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by letters patent of the united states is the invention as defined and differentiated in the following claims in which we claim:

1. A compressor stator comprising:

an arcuate half casing;

a plurality of vane sectors; and means for circumferentially interlocking each of said sectors to said casing for carrying respective portions of aerodynamic reaction forces from said sectors to said casing.

2. A stator according to claim 1 wherein:

said casing includes a circumferentially extending retention slot;

each of said sectors includes a vane extending from an outer band, with said outer bands being disposed in said slot; and said interlocking means are effective for circumferentially locking each of said outer bands to said casing.

3. A stator according to claim 2 wherein said locked outer bands circumferentially adjoin each other.

4. A stator according to claim 3 wherein said interlocking means comprise respective pluralities of outer and inner tabs fixedly joined to said outer bands and said casing, and circumferentially abutting each other in pairs.

5. A stator according to claim 4 wherein said tab pairs are axially offset from each other.

6. A method of mounting a plurality of vane sectors to an arcuate half casing comprising:

inserting circumferentially into said half casing each of said sectors; and interlocking circumferentially each of said sectors to said casing for carrying respective portions of aerodynamic reaction forces from said sectors to said casing.

7. A method according to claim 6 further comprising:

inserting each of said sectors in turn in a common slot in said half casing; and interlocking each of said sectors in turn to said half casing.

8. A method according to claim 7 further comprising interlocking each of said sectors to said half casing at axially offset locations.

9. A compressor stator 10 comprising:

a casing;

a plurality of vane sectors mounted in said casing;

a plurality of circumferentially spaced apart outer tabs fixedly joined to said casing; and a plurality of inner tabs 38 fixedly joined to respective ones of said sectors and interlocked with said outer tabs for circumferentially retaining said sectors in said casing.

10. A stator according to claim 9 wherein:

said casing includes a circumferentially extending slot, and said outer tabs extend radially inwardly therefrom; and each of said sectors includes an outer band disposed in said casing slot, and each of said outer bands includes a respective one of said inner tabs disposed in circumferential abutment with a corresponding outer tab in an interlocked tab pair.

11. A stator according to claim 10 wherein said tab pairs are axially offset from each other.

12. A stator according to claim 11 wherein:

said casing is formed in two half casings, with each half casing having a plurality of said vane sectors therein; and each of said sectors is interlocked with said half casings by a respective pair of said tabs.

13. A stator according to claim 12 wherein:

said casing slot in each of said half casings is open at circumferentially opposite ends for circumferentially receiving each of said vane sectors in turn; and said interlocked sectors circumferentially adjoin each other.

14. A compressor stator comprising:

an arcuate casing having a circumferentially extending slot 16 therein;

a plurality of vane sectors each having a plurality of vanes extending radially from an outer band, with each of said outer bands being mounted in said slot;

a plurality of outer tabs fixedly joined to said casing within said slot, and circumferentially spaced apart from each other; and a plurality of inner tabs fixedly joined to respective ones of said outer bands and interlocked with said outer tabs.

15. A stator according to claim 14 wherein:

each of said outer tabs extends radially inwardly from said casing inside said slot; and each of said inner tabs extends radially outwardly from said outer bands and circumferentially abuts a respective one of said outer tabs in an interlocked tab pair.

16. A stator according to claim 15 wherein:

said casing includes a plurality of holes extending therethrough into said slot; and said outer tabs are formed at distal ends of respective bolts extending through said holes to abut respective ones of said inner tabs.

17. A stator according to claim 15 wherein said tab pairs are axially offset from each other.

18. A stator according to claim 17 wherein:

said casing includes forward and aft hooks axially bounding said slot, and between which said outer tabs are disposed; and each of said sector outer bands includes forward and aft rails extending circumferentially on opposite axial sides thereof, and between which said inner tabs are disposed, and said rails are disposed on said hooks.

19. A stator according to claim 18 wherein:

said casing is formed in two half casings, with each half casing having a plurality of said vane sectors therein; and each of said sectors is interlocked with said half casings by a respective pair of said tabs.

20. A stator according to claim 19 wherein:

said casing slot in each of said half casings is open at circumferentially opposite ends for circumferentially receiving each of said vane sectors in turn; and said interlocked sectors circumferentially adjoin each other.

* * * * *